US009616315B2

(12) United States Patent
Smith

(10) Patent No.: US 9,616,315 B2
(45) **Date of Patent: *Apr. 11, 2017**

(54) GOAL TENDER LEG PAD

(71) Applicant: Warrior Sports, Inc., Warren, MI (US)

(72) Inventor: Peter B. Smith, Montreal (CA)

(73) Assignee: Warrior Sports, Inc., Warren, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/238,376

(22) Filed: Aug. 16, 2016

(65) Prior Publication Data

US 2016/0354672 A1 Dec. 8, 2016

Related U.S. Application Data

(63) Continuation of application No. 14/177,886, filed on Feb. 11, 2014, now Pat. No. 9,440,136.

(Continued)

(51) Int. Cl.

| | |
|---|---|
| ***A63B 71/12*** | (2006.01) |
| ***A41D 13/05*** | (2006.01) |
| ***A43B 5/18*** | (2006.01) |
| *A63B 102/24* | (2015.01) |

(52) U.S. Cl.

CPC ..... *A63B 71/1225* (2013.01); *A41D 13/0568* (2013.01); *A43B 5/18* (2013.01);

(Continued)

(58) Field of Classification Search

CPC ..... A63B 71/1225; A63B 207/125; A63B 2071/1241; A63B 2071/1258; A63B 2071/1283; A63B 2209/10; A63B 71/08; A63B 71/12; A63B 71/1241; A63B 2102/24; A63B 2102/1283; A41D 13/06; A41D 13/0587; A41D 13/0543; A41D 17/005; A41D 17/02

(Continued)

(56) References Cited

U.S. PATENT DOCUMENTS

| | | | |
|---|---|---|---|
| 3,761,960 | A | 10/1973 | Woodcock |
| 4,250,578 | A | 2/1981 | Barlow |

(Continued)

FOREIGN PATENT DOCUMENTS

| | | |
|---|---|---|
| CA | 2622862 | 10/2012 |

*Primary Examiner* — Gloria Hale

(74) *Attorney, Agent, or Firm* — Warner Norcross and Judd, LLP

(57) ABSTRACT

A goaltender leg pad providing profile adjustment, toe attachment and/or toe thickness adjustment. The leg pad can include an adjuster element that configures adjacent pads at a user selected angle or configuration to provide a desired front profile of the leg pad. The leg pad can include an optionally elastic toe attachment strap joined with a foot pad and/or boot, and a redirection element slidably engaging the strap. The strap can secure the foot pad to the user's skate, and generally centrally locate the foot pad over the user's skate when the user transitions to a standing position and/or a crouching position. The leg pad can include a foot pad configured to engage the top of a user's skate. The foot pad can define a cavity within which a secondary pad can be selectively installed or removed to alter the toe thickness of the foot pad and provide desired performance.

20 Claims, 14 Drawing Sheets

Related U.S. Application Data

(60) Provisional application No. 61/783,759, filed on Mar. 14, 2013.

(52) U.S. Cl.
CPC . *A63B 2071/125* (2013.01); *A63B 2071/1241* (2013.01); *A63B 2071/1258* (2013.01); *A63B 2071/1283* (2013.01); *A63B 2102/24* (2015.10); *A63B 2209/10* (2013.01); *A63B 2225/09* (2013.01)

(58) Field of Classification Search
USPC ..... 2/22, 24
See application file for complete search history.

(56) References Cited

U.S. PATENT DOCUMENTS

| | | | | |
|---|---|---|---|---|
| 4,868,926 | A | 9/1989 | Lowson | |
| 5,093,931 | A | 3/1992 | LaBerge et al. | |
| 5,172,425 | A | 12/1992 | Smith | |
| 5,238,652 | A | 8/1993 | Sun et al. | |
| 6,065,152 | A | 5/2000 | Parker | |
| 6,959,453 | B2 | 11/2005 | Best | |
| 7,823,218 | B2 | 11/2010 | Goyer et al. | |
| 8,261,369 | B2 | 9/2012 | Sioui et al. | |
| 9,440,136 | B2 * | 9/2016 | Smith | A63B 71/1225 |
| 2014/0259259 | A1 | 9/2014 | Smith | |

* cited by examiner

GOAL TENDER LEG PAD

CROSS-REFERENCE TO RELATED APPLICATIONS

This application is a continuation of U.S. patent application Ser. No. 14/177,886, filed Feb. 11, 2014, now U.S. Pat. No. 9,440,136, which claims benefit of U.S. Provisional Application No. 61/783,759, filed Mar. 14, 2013, which are hereby incorporated by reference.

BACKGROUND OF THE INVENTION

The present invention relates to sport equipment, and in particular to a goaltender leg pad.

Goaltenders in certain sports, such as hockey, typically are engaged in a high level of contact with other players and implements of the game, such as pucks and sticks. A goaltender's job is to prevent the puck or other item from entering the goal by catching the puck with a glove, or blocking the puck with a glove, a hockey stick, the goaltender's body or various pads such as leg pads.

Goaltender leg pads protect the goaltender's leg and also operate to provide a substantial blocking element. For the goaltender to prevent pucks from entering the goal, typically goaltenders will drop to one or both knees with their skates spread apart so that the puck cannot enter the goal, effectively using the leg pads to block the puck.

Goaltender leg pads are usually bulky and rigid. Most include multiple pads that are joined with one another to cover the front surface of a goaltender's leg. Leg pads come with either one of two profiles—straight or curved. Some goaltenders may desire certain other features of the leg pad. If those features do not come with the straight or curved front profile, then the goaltender must try to modify the leg pads. For example, if the goaltender acquires a leg pad with a relatively straight front profile and desires more of a curve, the goaltender has to forcibly push and/or compress the leg pad downward to create the desired curved shape. Where a goaltender acquires a leg pad with a large profile curve, they are usually stuck with that curve because it is difficult to straighten the curved front profile of the leg pads. Further, even after being forced into a desired profile, the pads typically will return to their original shape.

Most goaltender leg pads also come with a foot pad that generally sits atop the goaltender's skates. The foot pad is usually attached to the toe of the skate with an inelastic lace that extends downwardly from the foot pad, around a component of the skate, and then reattaches to the foot pad. This attachment generally keeps the skate and foot pad in close proximity. However, the laces used in this system generally do not provide a consistent return of the foot pad to a position over the skate. Further, when transitioning from a crouched or standing position, this can make the foot pad, and thus the leg pad, feel off balanced and sloppy. In some cases, the pad can remain in an undesired location over the skate and can cause an impediment to the goaltender's movement.

The foot pads of most conventionally manufactured leg pads also come in either one of two different thicknesses. The thickness of the foot pad generally dictates the engagement of the foot pad with the ice or other surface upon which the goaltender moves. Some foot pads are constructed to be flat so that when the user goes into a deep crouch, the pad does not engage the ice or surface. Others are slightly rounded, and in some cases, engage the surface more easily when in a crouching position. Again, goaltenders usually must trade off the ice engagement for some other feature of the goaltender leg pads, depending on a goaltender's preferences.

SUMMARY OF THE INVENTION

A goaltender leg pad with improved profile adjustment, toe attachment and/or toe thickness adjustment is provided.

In one embodiment, the goaltender leg pad can include a thigh pad, a knee pad, a lower leg pad and a foot pad. An adjuster flap can be joined with adjacent ones of the aforementioned pads. One end of the adjuster flap can be selectively repositioned relative to the two, to fasten that end to the adjacent pad. By selectively positioning the adjuster flap and overlapping it from one pad to the next, a user can adjust the leg pad to different front profiles depending on their preferences and performance requirements.

In another embodiment, the adjuster flap includes a first end and a second end. The first end is attached fixedly to one pad, while the second end overlaps and can be selectively joined with the adjacent pad in any one of multiple locations. By overlapping the adjuster flap second end by varying degrees with the adjacent pad, a user can set the relative angle between the pads and thereby establish a desired front profile of the leg pad. For example, by overlapping the adjuster flap more with an adjacent pad, the pads are set at a second angle that is less than a first angle established when the adjuster flap is overlapped less with the adjacent pad.

In still another embodiment, the adjustment flap can include the above noted first and second ends. The first end can be fixedly attached to a first pad, for example, a thigh pad. The second end can include a fastener. A corresponding fastener can be on a second, adjacent pad, for example, a knee pad. The fastener can be selectively attached to the corresponding fastener on the second pad to establish a desired tension in the flap. This tension can pull the first pad toward the second pad thereby creating a decreased angle between respective surfaces, for example, the rear surfaces of the first and second pads. In turn, this can operate to selectively adjust the front profile of the leg pad to a more rounded and/or curved profile.

In even another embodiment, the fasteners used in conjunction with the adjuster flap and an adjacent pad can be constructed to have a lengthwise shear strength of at least 10 PSI, 20 PSI, 30 PSI, 40 PSI, 50 PSI, 60 PSI or more depending on the particular application and the stiffness of the leg pad components.

In still even another embodiment, the leg pad can include a toe attachment strap joined with a foot pad and/or boot of the leg pad. The toe attachment strap can be configured to join part of the leg pad, for example, the foot pad, with the user's skate, thereby securing the user's skate to the foot pad. The strap can be constructed from an elastic material to provide desired movement of the foot pad relative to the skate, and optionally, return the foot pad to a desired central location over the skate.

In still yet another embodiment, the strap can be constructed to engage a redirection element that is joined with the foot pad and/or the boot. The redirection element can engage a central portion of the strap, allowing the strap to slide freely relative to the redirection element. The strap and redirection element can act in concert so that the strap can stretch an additional amount and provide a desired amount of movement of the skate relative to the foot pad, yet still quickly return the foot pad to a pre-desired location over the skate.

In a further embodiment, the redirection element can be in the form of a sleeve that extends across the longitudinal axis of the leg pad. The strap, where elastic, can stretch and retract within the sleeve as well as between the redirection element and the second end of the strap when a user transitions to varying positions, for example, to or from a standing and/or crouching position.

In still a further embodiment, the leg pad can include a toe thickness adjustment system. The foot pad can include a front and a rear, with the rear adapted to face the skate of a user. The foot pad can define a pad cavity in communication with an opening, which is accessible to a user.

In yet a further embodiment, the leg pad can include a secondary pad that is operable in an installed mode and a removed mode. In the installed mode, the secondary pad can be positioned in a pad cavity by the user. In turn, this provides a first thickness of the foot pad. In a removed mode, the user removes the secondary pad from the pad cavity to provide a second thickness, less than the first thickness of the foot pad. With this construction, a user has the option of adjusting the thickness of the foot pad to their desired performance characteristics and/or physical stature.

The present invention provides a goaltender leg pad that is customizable and adjustable. Where the profile adjustment mechanism is provided, a user can easily adjust the front or other profile of the leg pad to their desired performance characteristics and physical stature. Where the leg pad includes the toe thickness adjustment system, a user can easily change out secondary pads or remove secondary pads over the toe of a user's skate. This can provide a preferred feel and performance. Further, where included, the toe attachment strap system enables the user to quickly and easily attach a toe strap to the user's skate thereby securing the foot pad to the skate. The toe attachment strap system enables the leg pad to quickly and responsively return to center or another desired orientation of the foot pad relative to the user's skate. The above features provide a leg pad offering significantly improved performance.

These and other objects, advantages, and features of the invention will be more fully understood and appreciated by reference to the description of the current embodiment and the drawings.

Before the embodiments herein are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
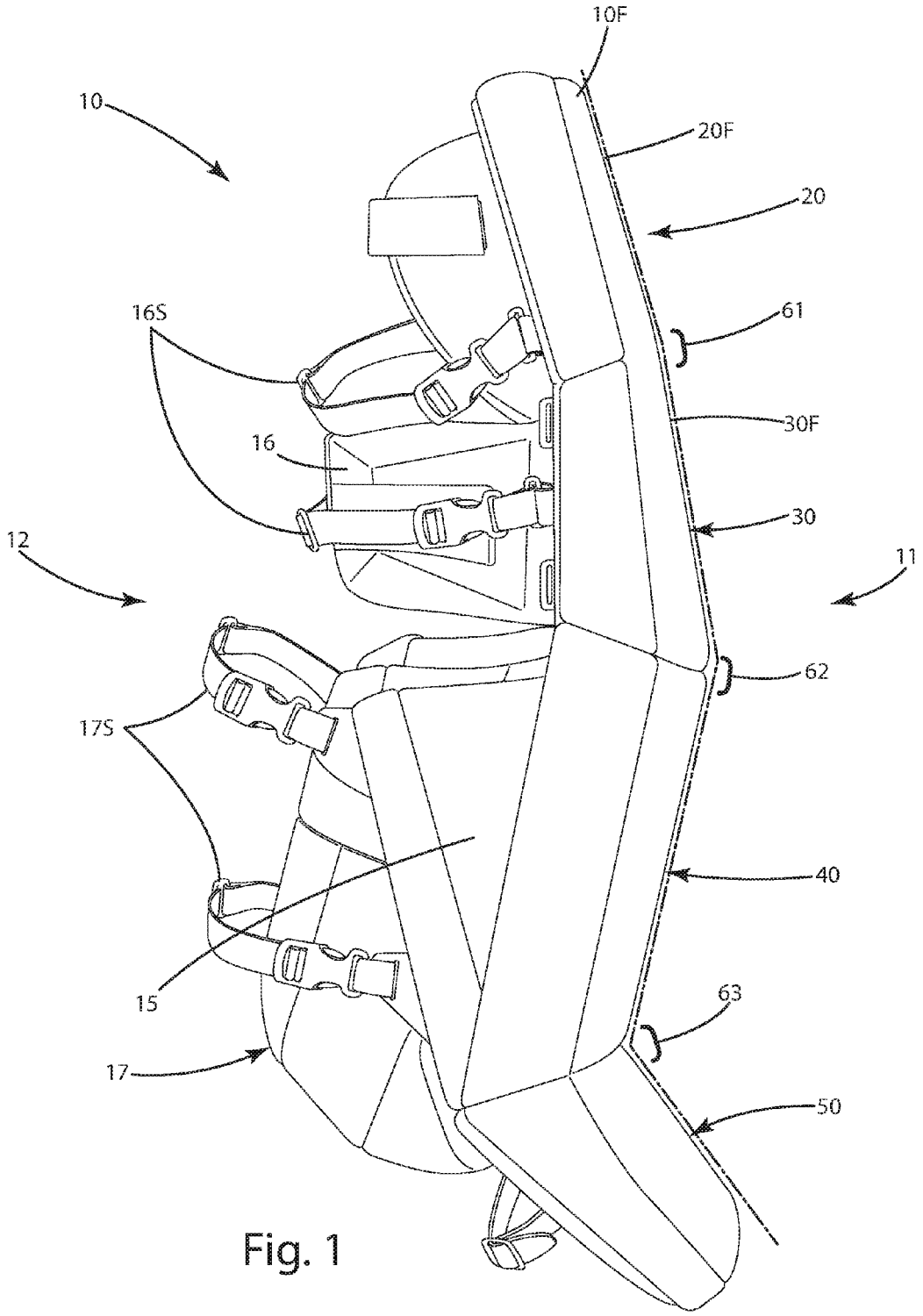
FIG. 1 is a side view of a goaltender leg pad of a current embodiment.

A goaltender leg pad, also referred to as a goalie leg pad, in accordance with a current embodiment is illustrated in FIGS. 1-15 and generally designated 10. While the drawing illustrates a right side leg pad, the current embodiment can be used in conjunction with a left-side leg pad which is generally a mirrored version of the right-side leg pad. Further, the components and construction in connection with the illustrated leg pad can be readily modified to other types of leg pads. Thus, while the current embodiment is described in the context of hockey equipment, it can be used for other types of protective pads outside of hockey. Indeed, the features and concepts described herein can be used in any padding system in which protection from impact is helpful.

Figure 2:
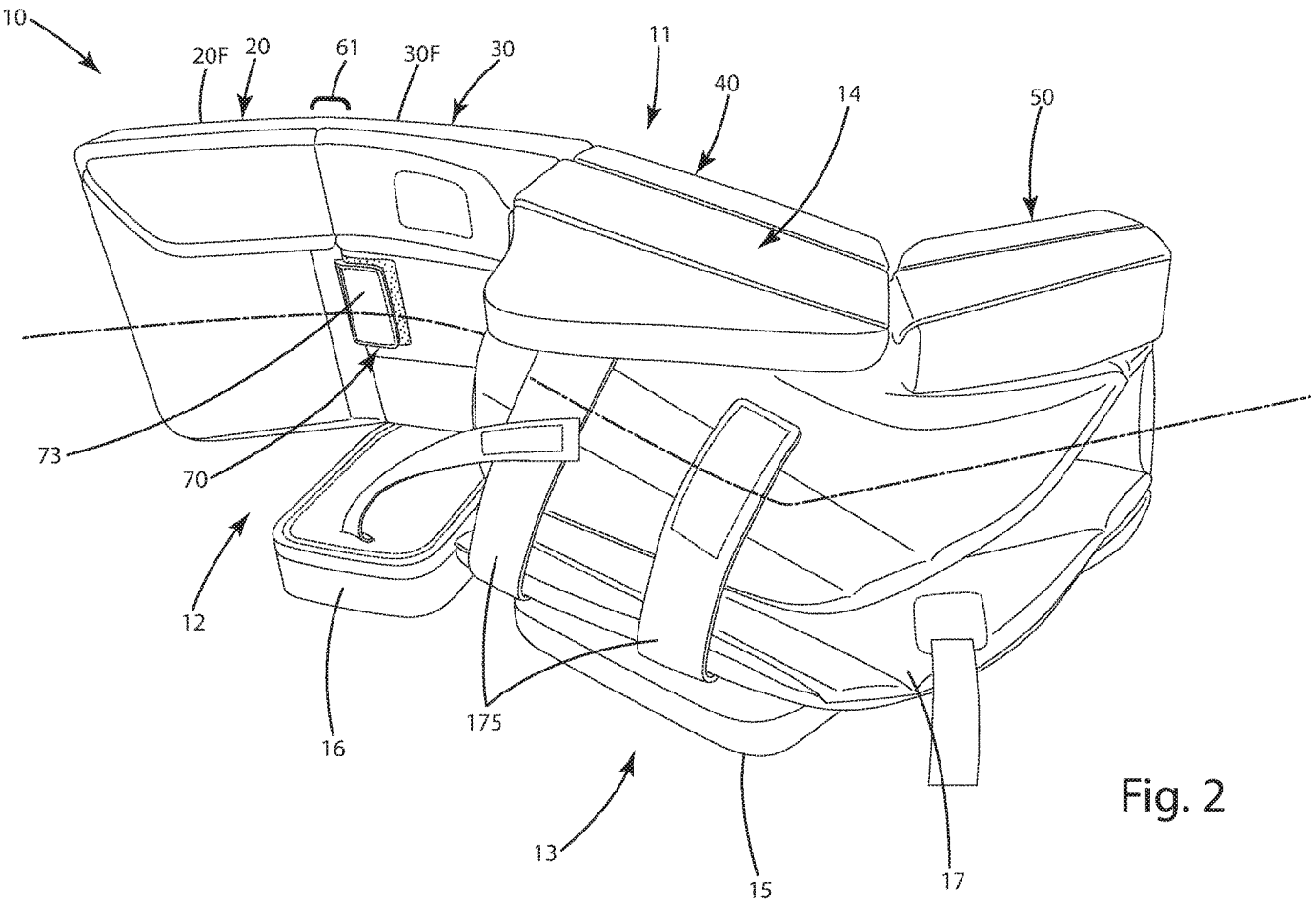
FIG. 2 is a rear perspective view of the leg pad of the current embodiment illustrating an adjuster flap.
Figure 3:
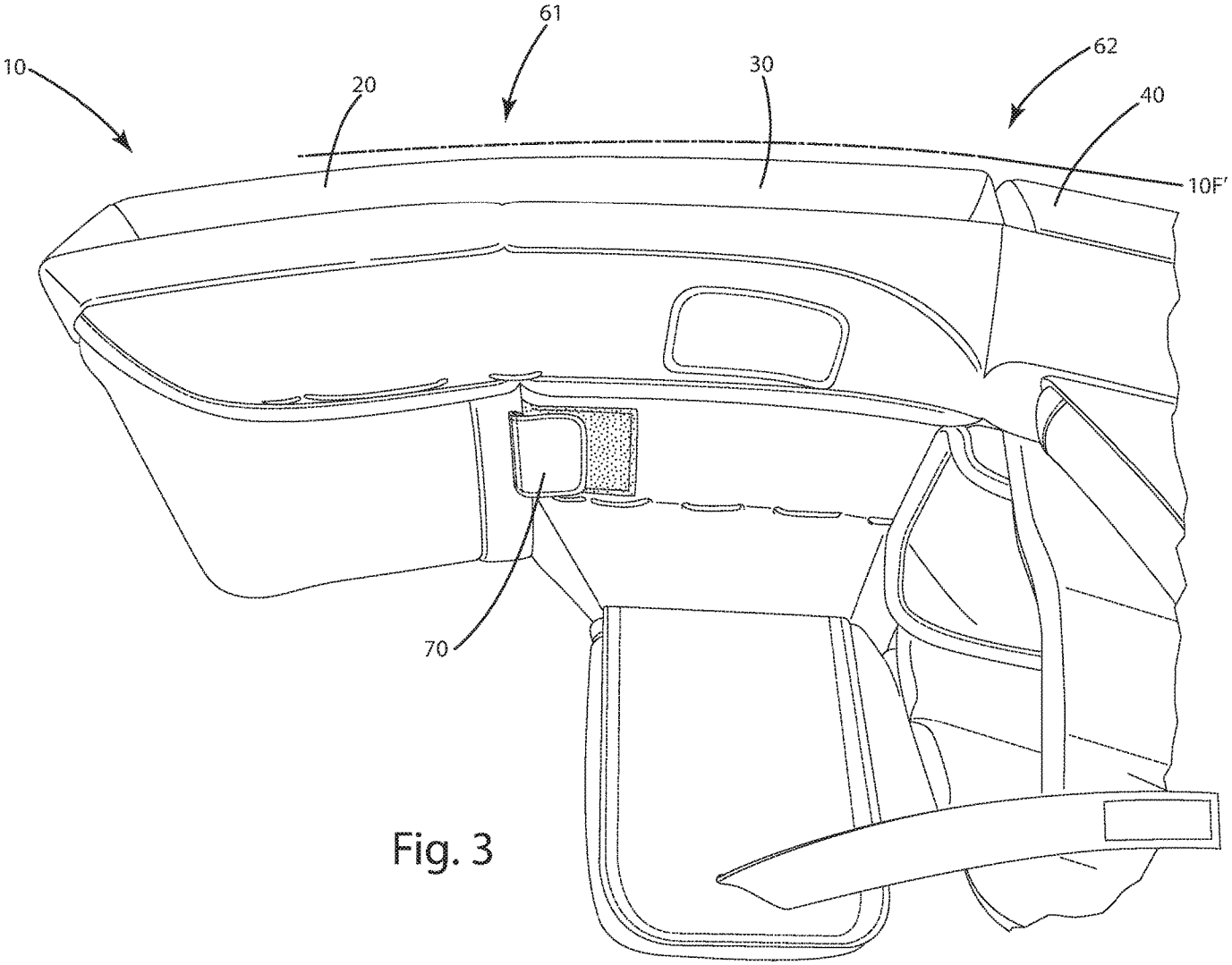
FIG. 3 is a rear perspective view of the leg pad in a straightened front profile mode.

As shown in FIGS. 1-2, the leg pad is generally configured to be attached to a user's leg. The leg pad generally includes a front 11 and a rear 12. It further includes opposing lateral 14 and medial 13 sides. Generally, the medial side is the "inner" side that a user, goes down with their knee when going into a butterfly position. The leg pad 10 is configured so that the front 11 includes a front profile, which generally faces forwardly, away from a user's leg when the leg pad 10 is installed on the user's leg. This front profile is also the profile that typically engages a puck, stick or other elements going toward the leg pad 10. The front profile 11 can include the collective profiles of multiple pads that make up the front of the leg pad 10 as described further below. Opposite the front profile 11 is a rear profile 12. The rear profile 12 is the profile of the rear surfaces of the pad that faces toward the user's leg. Generally, the rear profile 12 faces toward the user's leg.

Each of the respective pads can include a front and an opposing rear, for example, a front surface and an opposing rear surface. As a further example, the thigh pad 20 can include a front 20F and a rear 20R; the knee pad can include a front 30F and a rear 30R; the lower leg pad can include a front 40F and a rear 40R (FIG. 8); and the foot pad can include a front 50F and a rear 50R. Collectively, the fronts 20F, 30F, 40F and 50F of the various pads can make up the front profile 10F of the leg pad 10.

The leg pad can generally include a thigh pad 20, a knee pad 30, a lower leg pad 40 and foot pad 50. The thigh pad 20 can be configured to cover a user's thigh, for example, the front portion of their thigh. The knee pad 30 is joined with the thigh pad below the thigh pad. The knee pad 30 generally covers the user's knee, and for example, the forward or front portion of the knee. A lower leg pad 40 is joined with the knee pad 30 below the knee pad 30. The lower leg pad 40 can be configured to cover the lower leg of the user, and in some cases, the calf or side portions of the user's lower leg with additional padding. A foot pad 50 projects forwardly from the lower leg pad 40.

Figure 8:
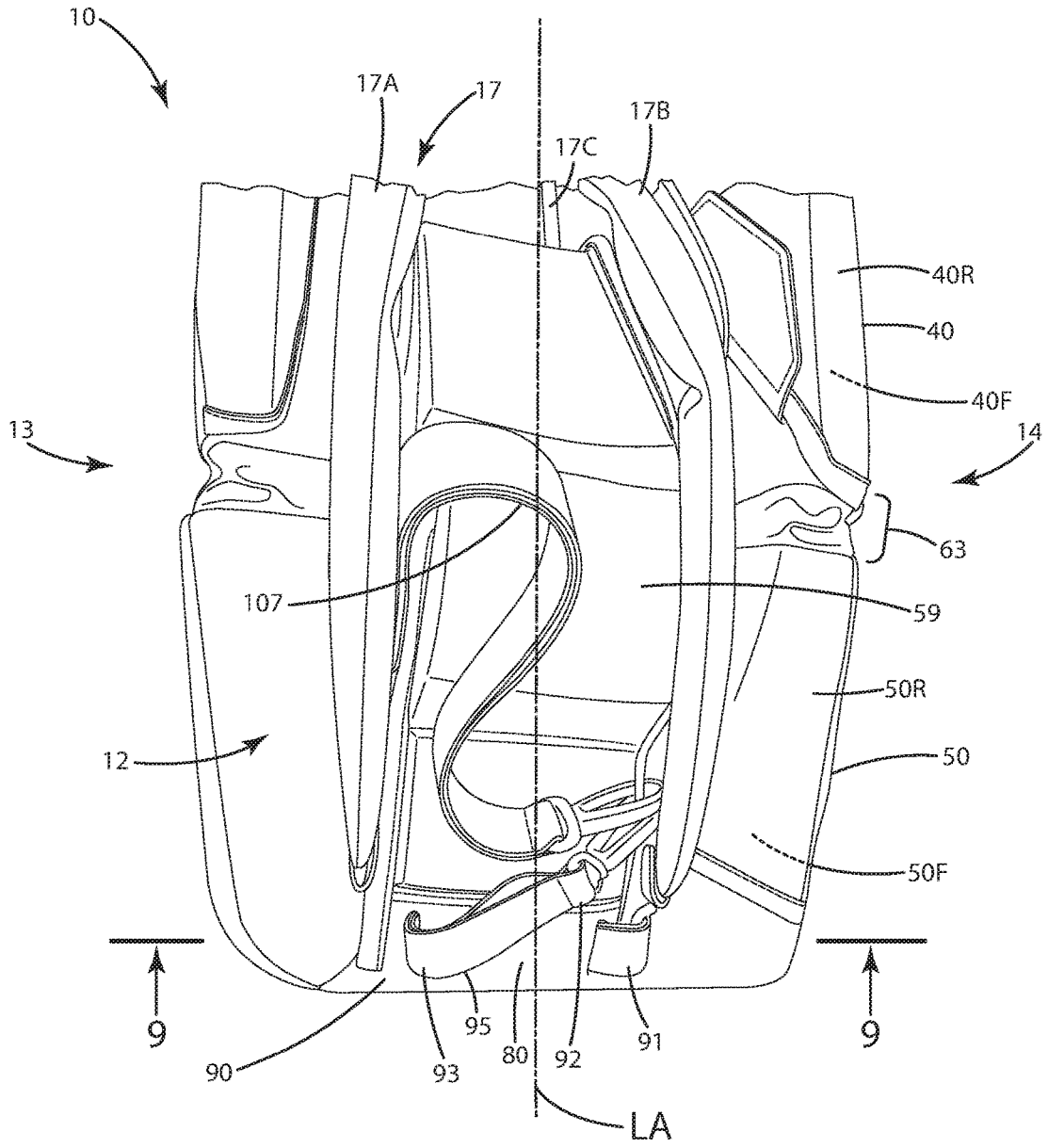
FIG. 8 is a rear perspective view of the leg pad illustrating a toe attachment strap system.

As shown in FIG. 8, the leg pad defines a longitudinal axis which generally extends centrally through the thigh pad, knee pad, lower leg pad and foot pad. Optionally, the longitudinal axis can bisect or generally divide the various pads laterally, separating them into the respective lateral side 13 and medial side 14 including the respective front and rear profiles.

Optionally, the thigh pad 20 and knee pad 30 can be referred to as the upper leg pad. If desired, these pads can be generally formed as one pad rather than separate pads.

The pads are joined with one another so that adjacent pads can flex, pivot, rotate, bend, fold or otherwise move relative to one another. As used herein "flex region" means and includes, for example, adjacent pads that are joined with one another but remain movable relative to one another about a pivot point, a pivot axis, a pivoting region, a flexing region, a location and/or multiple locations. Generally, a flex region can include a region, point or axis about which a first pad rotates, bends, folds, flexes, hinges, pivots or otherwise moves relative to a second pad. In some constructions, the flex region can be established, for example, by having two inner pads joined to one another with a cover, where the cover flexes or pivots between the adjacent pads. In other cases, the thickness of the padding member can be varied in the flex region by thinning, recessing, cutting, scoring and/or creating a cavity between the adjacent pads so that they rotate, bend, fold, flex, hinge, pivot or otherwise move relative to one another within the flex regions, which also can be referred to as hinge regions herein.

With reference to FIG. 1, the leg pad 10 can include one or more flex regions. For example, a first flex region 61 can be disposed between the thigh pad 20 and the knee pad 30. A second flex region 62 can be disposed between the knee pad and the lower leg pad 40. The first flex region 61 and the second flex region 62 are generally configured to be disposed above and below a user's knee when the leg pad 10 is installed on the user's leg. A third flex region is disposed between the lower leg pad 40 and the foot pad 50. Generally, the flex regions 61, 62 and 63 can have the same or optionally can have different flexibilities. For example, the adjacent pads can move more or less rigidly relative to one another. In many cases, the second flex region 62 and the third flex region 63 can be less flexible than the first flex region 61.

The leg pad 10 can also include a calf guard 15 and a secondary knee pad 16. The calf guard 15 can be duplicated on both sides of the user's calf, generally fitting and protecting on opposing sides of the calf or lower leg. The secondary knee pad 16 can be disposed on the medial 13 side of the leg pad so that when the user goes down into a butterfly or partially kneeling position, the secondary knee pad 16 is disposed between the user's knee and the ice or surface upon which the user kneels.

Optionally, the leg pad 10 can be constructed with a boot 17. As shown in FIG. 8, the boot 17 can include a central channel 17C within which the user's skate, shin, lower leg or other portion are positioned. The boot 17 also includes side rails 17A and 17B which can extend rearwardly from the rear surface 50R or rear of the foot pad 50 and/or rearwardly from the rear surface 40R of the lower leg pad 40. Generally, the boot can surround, house or encase at least a portion of the user's skate and/or shin or lower leg.

The boot 17 can be joined and/or secured with the user's lower leg and/or skate via one or more straps 17S as shown in FIGS. 1 and 2. The leg pad 10, and in particular, the thigh pad 20 and knee pad 30 can be likewise secured to the user's leg via a system of straps 16S. The straps can include any type of fasteners, D-rings or other devices so that a user can removably attach the leg pad and its components to the user's leg. Optionally, snaps, clips, and/or hook-and-loop fasteners such as Velcro™ can be used in securing the leg pad via the straps.

Figure 5:
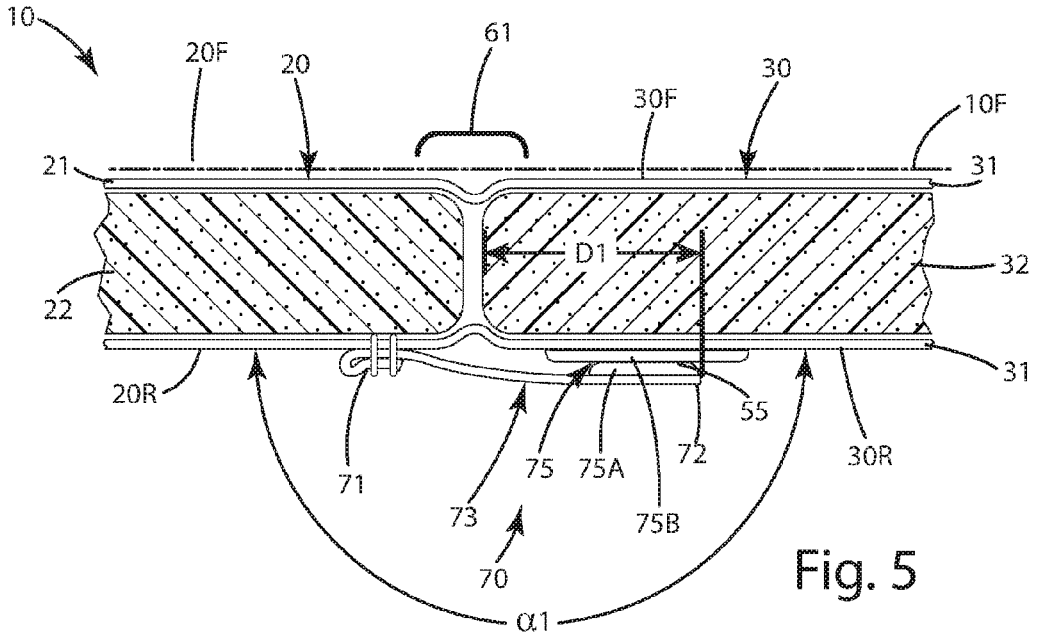
FIG. 5 is a section view of adjacent pads in the leg pad with the adjuster flap and the pads in a first mode, such as a straightened front profile mode.
Figure 6:
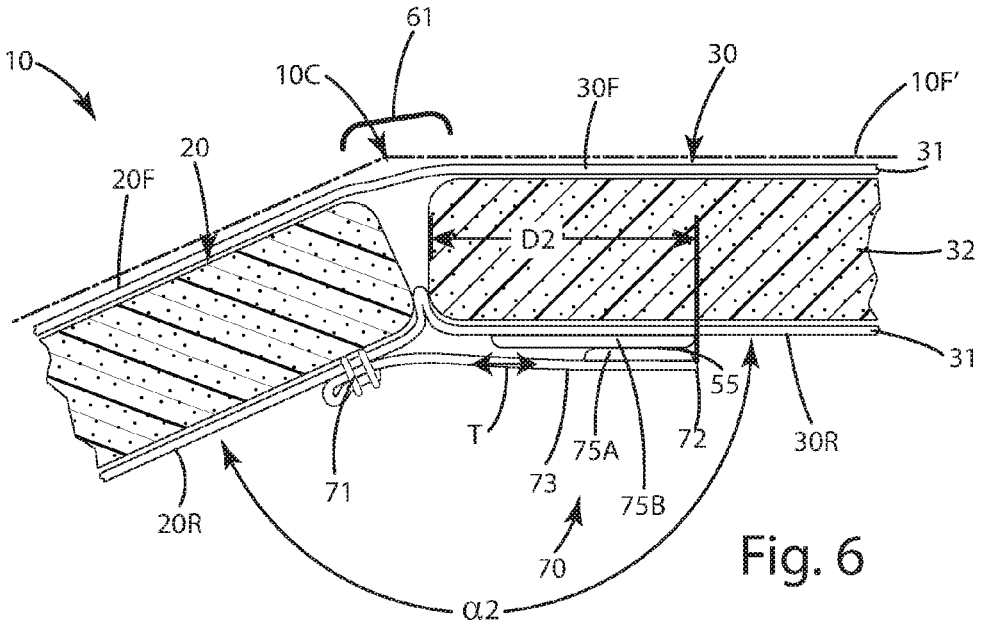
FIG. 6 is a section view of adjacent pads in the leg pad with the adjuster flap and the pads in a second mode, such as a rounded or bent front profile mode.

As shown in FIGS. 5 and 6, the various pads can include an outer layer, such as a cover that generally wraps or extends over internal padding or pads. The outer layer, when in the form of a cover, can be constructed from a wear-resistant material such as leather, nylon, polyvinyl chloride, plastic and/or other materials. The internal padding where used, can be in form of a high-density foam, polyurethane, densely packed material or other padding that provides padding and protection to a wearer of the leg pad 10 when the leg pad is struck with a puck or other item. The padding can be generally rigid, but somewhat flexible.

The thigh pad 20 can include a cover 21 which may or may not be contiguous with the cover 31 of the knee pad 30. The covers 21 and 31 can extend over the internal pads 22 and 32 of the respective components of the respective thigh pad and knee pad.

A. Profile Adjustment System

Figure 7:
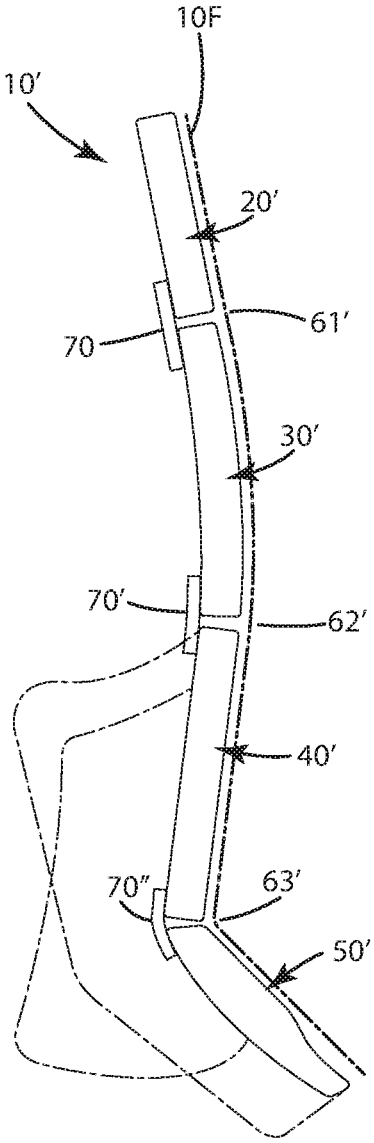
FIG. 7 is a side view of an alternative construction for the leg pad incorporating alternative adjuster flaps.

As shown in FIGS. 2-6, the leg pad 10 can include a profile adjustment system 70 also referred to as a profile adjuster. The profile adjuster 70 as shown is generally configured and constructed to adjust the front profile 10F of the leg pad which generally faces forwardly away from the user's leg. As mentioned above, the front profile 10F can be a collection of profiles of the fronts of the various pads, for example, 20F, 30F, 40F and 50F. In some cases, only a small portion of the profile can be adjusted with the profile adjuster 70. For example, in the embodiment shown in FIGS. 2-6, the profile adjuster 70 is constructed to adjust the front profile 10F in the region adjacent the front 20F of the thigh pad 20 and the front 30F of the knee pad 30. As shown in FIG. 8, the leg pad also defines a longitudinal axis which generally extends centrally through the thigh pad, knee pad, lower leg pad and foot pad. Optionally, the longitudinal axis can divide the various pads laterally, separating them into the respective lateral side 13 and medial side 14 including the front and rear profiles. For example, as shown in FIG. 7, the front profile 10F of an alternative leg pad 10' can include one or more additional profile adjusters in addition to the adjuster 70. A profile adjuster 70' can be disposed between the knee pad 30' and the lower leg pad 40'. A profile adjuster 70 can be disposed between a lower leg pad 40' and the foot pad 50'. These additional and/or alternative adjusters 70', 70" can be virtually identical to the profile adjuster 70, and can likewise facilitate adjustment of the front profile 10F of the leg pad 10' at any one or more desired locations where pads adjoin or are adjacent one another. Further, the profile adjuster and its adjustment flap as described below can be disposed over any of the other flex regions 62 and 63 of the leg pad in addition to, or in the alternative, relative to the first flex region 61.

Returning to FIG. 2, the profile adjuster 70 of the current embodiment of the leg pad 10 can include an adjuster flap 73. This adjuster flap 73 can be a panel constructed from material from which the cover described above is constructed. The adjuster flap can alternatively be constructed from a more rigid plastic panel or sheet, a nylon web or strap-like material. Optionally, in such a construction, the plastic sheet can be enclosed or housed within a cover. As shown, the adjuster flap is a single component extending between the adjacent pads. Optionally, the flap 73 can include multiple individual flaps or straps extending between those components.

The adjuster flap 73 can be disposed centrally relative to the longitudinal axis LA. For example, the adjuster flap 73 can extend across the longitudinal axis and can be located on both sides of the longitudinal axis. Optionally, the flap can be on either one of the lateral 14 and medial 13 sides of the longitudinal axis as desired. Further, one adjuster flap can be on the lateral side 14 and another can be on the medial side 13.

As shown in FIGS. 5 and 6, the adjuster flap 73 of the profile adjuster 70 can include a first end 71 and second end 72. The first end 71 can be fixedly joined with a first pad, for example, the thigh pad 20 as illustrated in FIG. 5. The second end 72 can be removably or detachably joined with the second pad, for example, the knee pad 30 also shown in FIG. 5. The first end 71 can be fixedly attached by stitching, gluing, RF welding and/or stapling the adjuster flap 73 at the first end 71 to the cover 21 and/or pad 22 or any other structural component of the thigh pad 20. Although not shown, the first end 71 can alternatively be removably or detachably attached, similar to the second end, relative to the thigh pad 20.

The second end 72 of the adjuster flap 73 can include a fastener 75. The fastener can be a hook-and-loop fastener system including a first hook-and-loop fastener 75A, joined with the second end 72, and a corresponding second hook-and-loop fastener 75B joined with the cover 31 of the second pad, which is shown as the knee pad 30, or any component thereof. For example, the corresponding fastener 75B can be attached to the rear 30R of the knee pad 30, the internal pad 32 itself, or any other structure as desired.

Although shown as a hook-and-loop fastener 75, the fastener can be any alternative fastening system, for example, a button, a needle and eye system, a grid of pins affixing to corresponding apertures, or any other construction that provides selective orientation or location of the first fastener 75A relative to the second fastener 75B.

The second end 72 can be detachable from the knee pad 30, for example, its rear surface 30R, by decoupling the fasteners 75A and 75B from one another. The flap 73 can be foldable toward and away from the rear 30R of the pad 30. For example, when the first fastener 75A is detached from the second fastener 75B, the fastener flap 73 can be folded or otherwise moved away from the rear surface 30R. In reverse, it can then be moved toward the rear surface 30R so that the first fastener 75A and second fastener 75B contact and engage one another sufficiently to join the adjuster flap with the second pad, that is, the knee pad.

The fastener 75, whether a hook-and-loop fastener or any other type of fastener system, can have a lengthwise shear strength sufficient to hold the thigh pad 20, folded, bent and/or moved toward the knee pad 30 in a preselected orientation as the leg pad is used thereby fixing the front profile of the leg pad.

The pad is operable in a first mode shown in FIG. 5 and a second mode shown in FIG. 6. In the first mode, the pads 20 and 30, and in particular, the rear surface 20R and 30R are disposed at a preselected angle $\alpha 1$. This angle $\alpha 1$ can be optionally 170° to about 190°, further optionally about 180° so that the front profile 10F of the leg pad 10 is generally straight, at least in the area of the thigh pad 20 and the knee pad 30. In such a configuration, the adjuster flap 73 can exert little to no force on the pads. In this first mode, the shear forces between the first fastener 75A and the second fastener 75B are relatively minimal, if not zero. The fasteners are primarily holding the second end 72 connected to the pad 30. The adjuster flap 73 itself can be under minimal or no internal tension because, again, the adjuster in that mode optionally is not operating to bend, flex and/or move the first and second pads 20 and 30 relative to one another to change the leg profile 10F.

A user can adjust the profile adjuster 70 and/or adjuster flap 73 from the first mode to a second mode. In the second mode, the adjuster flap 73 is selectively joined with the second pad, for example, the knee pad shown in FIG. 6, in a different orientation and/or at a different location than it is in the first mode. The adjuster flap 73 can be selectively joined with the second pad 30 a greater distance from the flex region 61 or generally the interface of the thigh pad 20 and the knee pad 30. For example, as shown in FIG. 5 in the first mode, the end 72 is disposed a first distance D1 from the flex region 61 and/or interface of the thigh pad 20 and the knee pad 30. As shown in FIG. 6, however, in the second mode, the end 72 is attached to the knee pad 30 at a second distance D2, which is greater than the first distance D1. The difference between D1 and D2 can be as little as a ¼ inch. In other cases, it can be greater than ½ inch, ¾ inch, 1 inch, 1½ inch or 2 inches depending on the flexibility of the respective pads about the flex region 61 and the desired angle and/or curve in the front profile 10F of the leg pad. To accommodate the additional amount of movement in the end 72 of the adjuster flap 73, the fastener 75 can be constructed so that the fastener 75B is lengthwise larger than the first fastener 75A. Thus, the fastener 75A can be moved and attached farther away from the flex region 61 or other reference portion of the pad. Optionally, the fastener 75A and the adjuster flap can selectively overlap the fastener 75B and second pad 30 to varying degrees. Generally, the more the overlap, the greater the bending and rounding of the front profile 10F.

In the second mode shown in FIG. 6, the second end 72 is selectively joined with the fastener to the second pads 30 at a second location. Again, that location can be farther distanced from the flex region 61 or the interface of the adjacent pads. To achieve this orientation, a user bends or moves the thigh pad 20 "toward" the knee pad 30, and then, after a preselected front profile 10F' is acquired, fastens the fastener 75 at the second end to join the second end 72 with the knee pad 30. After the user releases the thigh pad 20, the thigh pad 20 tends to want to bend or move back to its previous profile 10F shown in FIG. 5. As a result, a tension T is established in the adjuster flap 73. The tension T is translated to the fastener, which further translates to exert a lengthwise shear across the joined fasteners 75A and 75B. Again, due to the lengthwise shear strength SS of the fasteners relative to one another, the second end 72 remains joined with the knee pad 30 to hold the profile 10F'.

Figure 4:
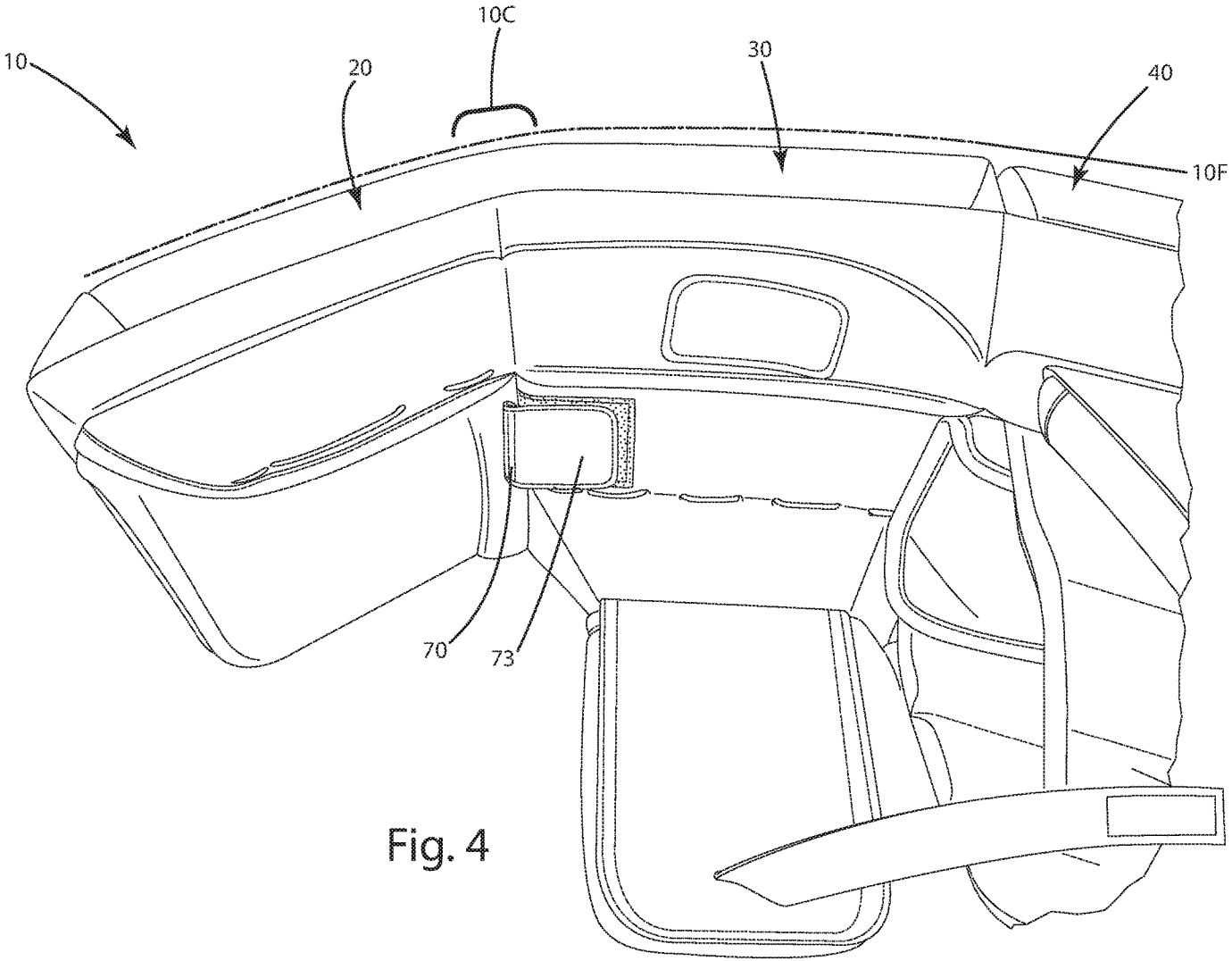
FIG. 4 is a rear perspective view of the leg pad in a rounded front profile mode.

With the adjuster flap 73 holding the thigh pad 20 and the knee pad 30 in the preselected configuration of the second mode shown in FIGS. 4 and 6, the front profile 10F' is held in the configuration as shown. This provides a curve 10C in the flex region 61. The amount or degree of curve 10C can be preselected and established by the user depending on the desired performance characteristics of the leg pad 10. The profile adjuster 70, including the adjuster flap 73, can orient the rear surfaces 20R and 30R relative to one another at a second preselected angle $\alpha 2$ in the second mode. The second angle $\alpha 2$ can be less than the first angle $\alpha 1$ shown in FIG. 5. For example, the angle $\alpha 2$ can be less than 180°, optionally between 120° to 179°, further optionally about 150° to about 170°, even further optionally about 165°. The angle $\alpha 2$ can be preselected depending again on the desired curvature and front profile 10F' of the leg pad 10.

In general, when in the first mode, the profile adjuster including the adjuster flap maintains the front profile 10F in a generally straight configuration, for example, the front surfaces 20F and 30F of the respective pads lay substantially within the same plane, plus or minus 5° to 10°. In the second mode, the profile adjuster including the adjuster flap holds the front profile 10F' so that it has a generally rounded configuration, particularly at the curve 10C, near the flex region 61. Generally, the respective pad, are not within the same plane. The user can select a variety of intermediate profiles and curvatures other than those shown in the figures. These other profiles can be achieved by selectively placing the second end relative to the second pad and securing it with the fasteners at a variety of different locations.

B. Toe Attachment System

Figure 9:
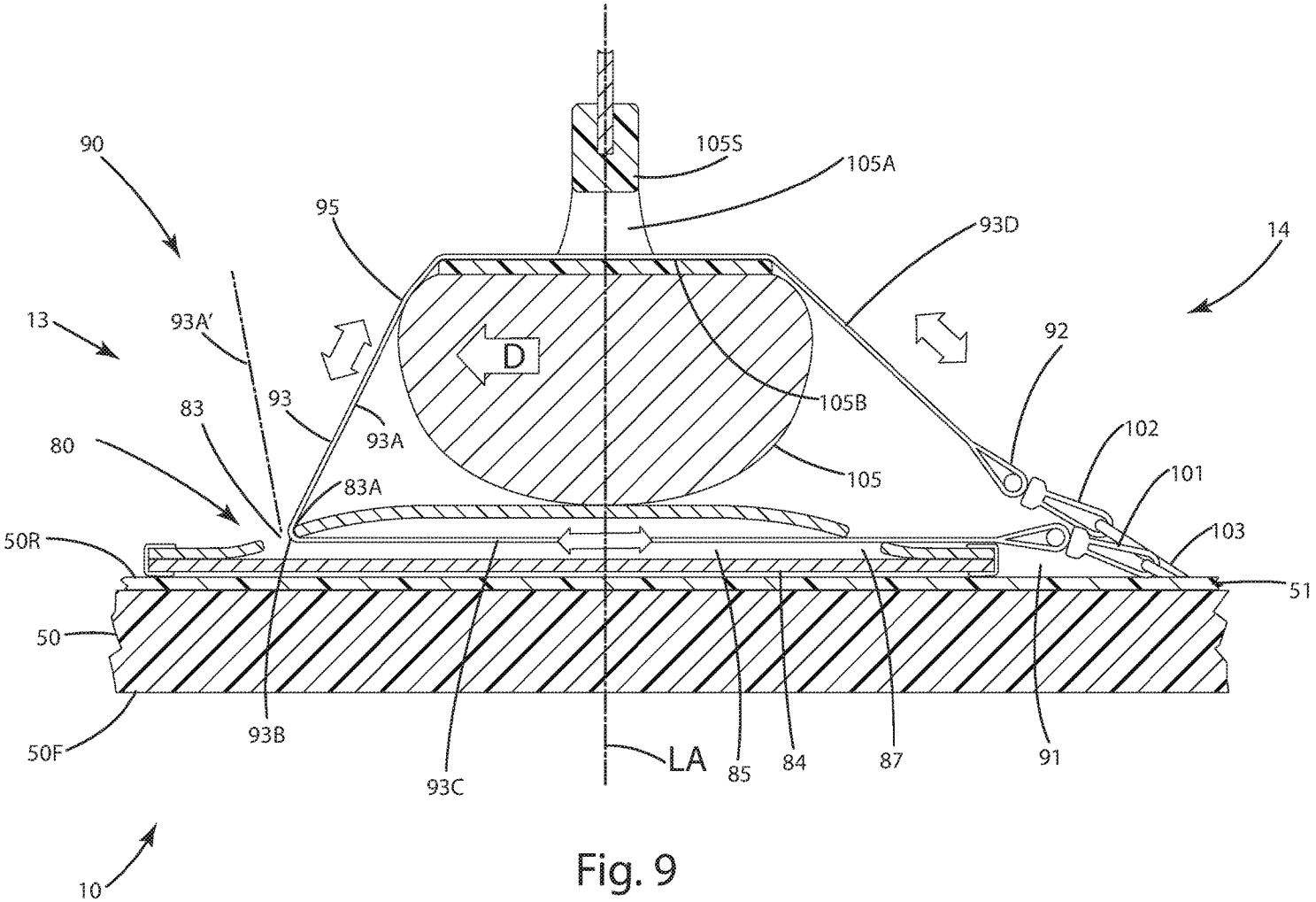
FIG. 9 is a section view of the toe attachment strap system with a skate adjacent a foot pad of the leg pad.
Figure 10:
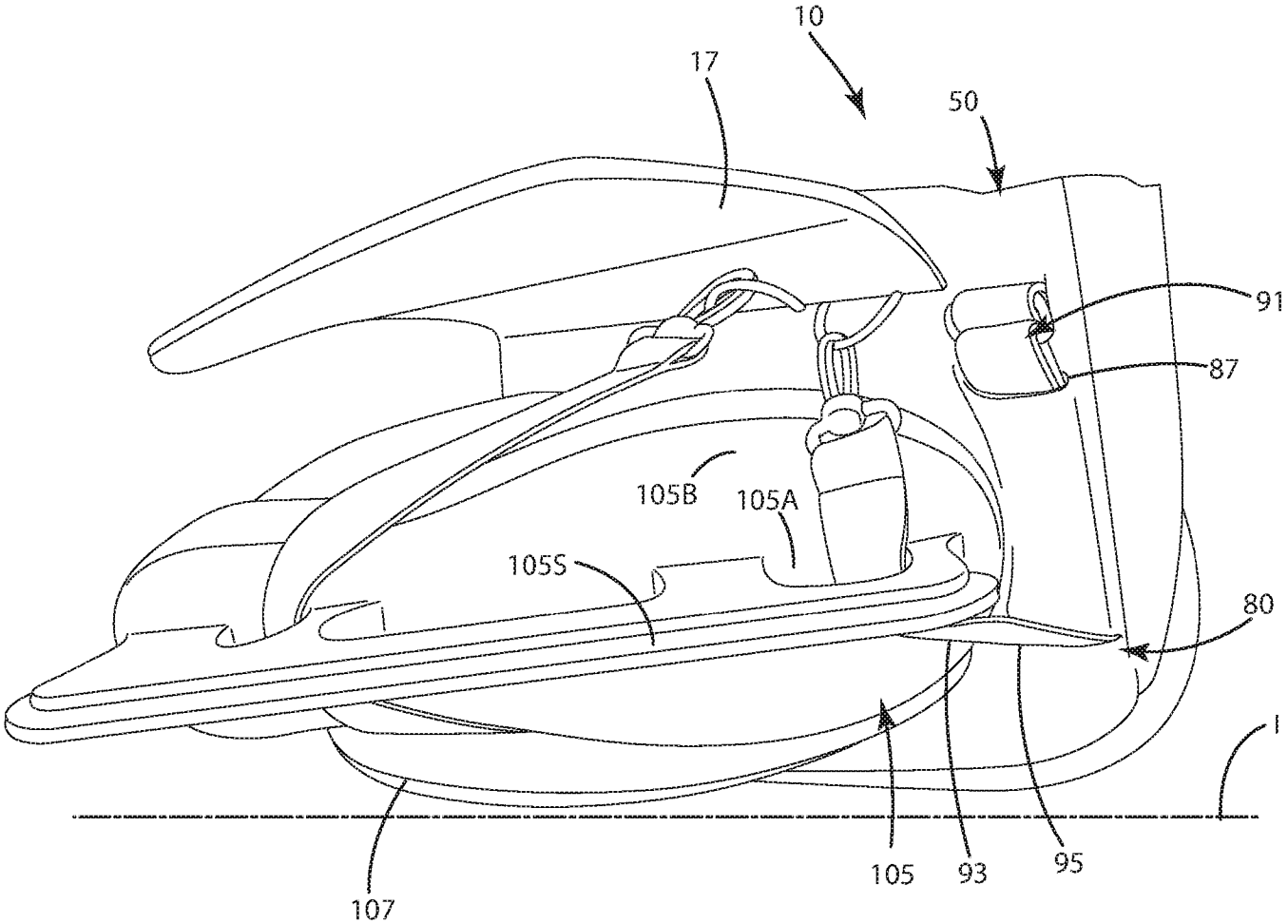
FIG. 10 is a perspective view of the toe attachment strap system with the skate in a down or lowered position.

The leg pad 10 can include a toe attachment system 90 as shown in FIGS. 8-10. The system generally can include a strap 95 that is joined with the foot pad 50 and/or the boot 17. The strap 95 operates in concert with the redirection element 80.

The strap 95 can be constructed from an elastic material, such as Lycra®, spandex, nylon, nylon interwoven with an elastomeric material, an elastomeric material alone, natural or synthetic rubber, or other stretchable fibers, whether woven, matted or solid construction, or some other material. When constructed from an elastic material, the strap can be extended or stretched to a length greater than its original length, and then can return by memory to its original length or something very close to it after repeated uses.

As shown in FIGS. 8 and 9, the strap 95 generally includes a first end 91 and a second end 92. The first end 91 can be secured to the foot pad 50 and/or boot 17 via a first attachment element 101. This first attachment element 101 can be a D-ring, a loop, a stitch, an RF weld, or other fastening structure that attaches the first end 91 to the pad 50. The first end 91 can be attached directly to a cover 51 or to an internal pad of the foot pad 50. The second end 92 can include a fastener that can be manually and detachably secured to a second attachment element 102. For example, the second end 92 can be joined with a clasp, hook, loop or other structure that can be joined with a D-loop 103 or some other structure joined with the foot pad 50 and/or boot 17. Generally, the fastening element 102 can be manually operable so that the strap 95 can be threaded through a portion of the user's skate 105, for example, between the bottom of the skate 1058 and the skate blade 105S through an aperture 105A shown in FIGS. 9 and 10.

Optionally, in addition to the toe attachment system 90, the leg pad 10 can include an optional boot strap 107 which generally is joined with the boot 17 and/or foot pad 50. The boot strap 107 can secure to the skate 105 at a rear portion of the skate.

As shown in FIG. 9, the elastic strap 95 can include a central portion 93 which is located generally between the first end 91 and the second end 92. The central portion 93 can include subparts 93A, 93B and 93C. Subpart 93B can be interfaced with and passed through a portion of a redirection element 80, and in particular, a hole or aperture 83 defined by a portion of the redirection element 80. Generally, the central portion 93, and the subparts 93A, 93B and 93C can be configured to interact with and engage a rim or perimeter of the hole 83. Where the strap 95 is elastic, the central portion 93 can slide relative to the hole 83, and in particular, the perimeter 83A around the hole. During this sliding movement, the strap 95 engages the redirection element 80, for example, the perimeter of the hole 83. The redirection element, for example, the hole 83 can be configured so that the central portion 93 pivots and moves about the hole.

In the configuration shown in FIG. 9, the subpart 93A is located and extends generally from the perimeter 83A of the hole 83. The skate 105 is in a first orientation relative to the foot pad 50. The skate 105, however, can slide in the direction D, for example, when the user drops to the ice I and the skate 105 is forcibly moved toward the medial side 13 of the leg pad. In so doing, the subpart 93A moves from the configuration shown in solid lines to the configuration 93A' shown in broken lines to accommodate the movement of the skate. Simultaneously, the subpart 93A, the subpart 93B and the subpart 93C all stretch or extend a predetermined amount, for example, 1%, 2%, 3%, 4%, 5%, 10%, 15%, 20%, 30% and/or more or less depending on the particular application.

Usually during this movement of the skate 105 in direction D, the subpart 93 of the central portion 93 pivots about the redirection element 80, and in particular, the hole 83. The subpart of the central portion 93 also simultaneously can slide or move relative to the hole 83 and its perimeter. For example, where the strap 95 is elastic, a portion of the subpart 93C can move through the hole 83 stretching as the strap 95 stretches. In so doing, the subpart 93C can also undergo an additional tension or stretch as shown by the arrows adjacent the subpart 93C. Other subparts, such as 93A, 93C and 93D can undergo similar stretching, tension and/or other forces, as also indicated by two-way arrows.

Generally, the strap 95 and central portion 93 can stretch and retract between the redirection element 90 and the second end 92, as well as between the redirection element 80 and the first end 91. When it retracts, the strap can operate to locate the foot pad 90 centrally over the user's foot and/or skate 105.

As shown in FIGS. 8 and 9, the redirection element 80 can be constructed in the form of a sleeve 84. The sleeve 84 can include an internal compartment 85 within which the strap 95 moves. For example, the strap and its central portion can slide within the internal compartment 85. Where it is elastic, the strap 95 also can stretch and retract within the compartment 85. As a further example, the subpart 93C of the central portion 93 can stretch and retract within the sleeve, generally moving relative to the sleeve as the strap is stretched from and retracts back to an original length.

Optionally, the sleeve 84 can be configured to engage the uppermost portion of the skate 105 when the leg pad 10 is installed on a user's leg. Generally, the sleeve can prevent the strap 95 from being snagged on the skate, and can allow the strap to freely stretch and retract and/or move relative to the skate, optionally within the internal compartment 85 of the sleeve 84.

As shown in FIG. 9, the sleeve 84 and strap 95 extend from the lateral side 14 to the medial side 13, traversing the longitudinal axis LA. The opening 83 of the redirection element can be defined by the sleeve 84 and in communication with the internal compartment 85. The opening 83 can be defined by the sleeve on the medial side 13 of the longitudinal axis LA. Generally, the first 91 and second 92 ends of the strap 95 can be disposed on the lateral side 14 of the longitudinal axis LA. The first end 91, however, can be moved so that it is secured to the foot pad 50 and/or boot 17 on the longitudinal axis LA and/or on the medial side, provided there is enough stretch in the strap 95 to provide the desired movement and to return the foot pad 50 over the skate 105 in a central or other desired location.

The sleeve 84 can be constructed to define another hole 87 disposed generally on the lateral side 14 of the longitudinal axis LA. This hole 87 can be configured to accommodate the central portion 93 and/or first end 91 extending from the exterior of the sleeve 84 to the internal compartment 85. Although shown as being located on the lateral side 14 of the longitudinal axis LA, this hole 87 can be on the longitudinal axis and/or on the medial side as desired.

The redirection element 80 and strap 95 and the toe attachment system 90 in general are configured to enable a skate to move relative to the foot pad 50, for example, when the user drops to the ice in a butterfly or a crouching position, yet snap or relocate the foot pad 50 generally centrally over the user's skate when the user returns to an upright or standing position. As shown in FIG. 10, the skate 105 is moved to simulate the user dropping to the ice I, with the skate disengaging the ice I. The strap 95 in this configuration is stretched and under a certain amount of tension. When the user returns to an upright position, where the skate 105S re-engages the ice, the strap and redirection element of the toe attachment system function to move the foot pad 50 generally centrally over the skate 105 as shown in FIG. 9.

Figure 11:
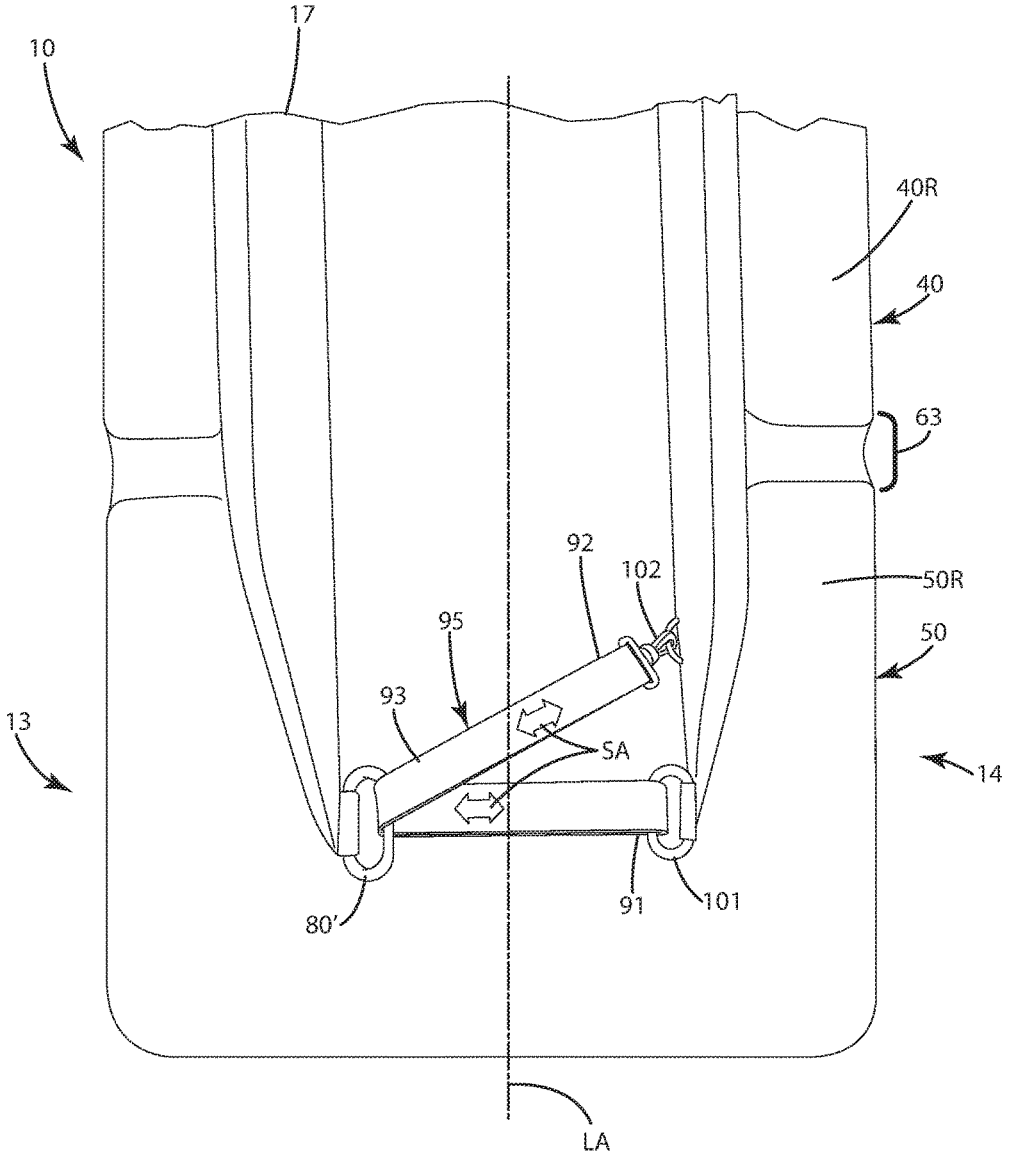
FIG. 11 is a rear view of the toe attachment strap system illustrating an alternative redirection member.

Optionally, the redirection element 80 can be modified. For example, as shown in FIG. 11, the redirection element 80' is in the form of a D-ring, also referred to as a D-loop herein. The D-ring can be attached directly to the foot pad 50 and/or boot 17. The D-ring can be slightly movable and pivotable about its attachment point to these elements. The redirection element 80' is located on the medial side 13 of the longitudinal axis. The strap 95 includes the first end 91 which is attached to the first fastener element 101 and a second end 92 which is attached to the second fastener element 102. Similar to the embodiment described above, the central portion 93 of the strap 95 is configured to move, for example, by pivoting and/or simultaneously sliding relative to the redirection element 80'. The central portion 93 and generally the strap 95 can slide relative to the redirection element 80' as the strap itself moves and/or stretches in the direction of the stretching arrows SA. Like the embodiment above, the different portions of the strap, for example, those between the second end 92 and the central portion 93, and the first end 91 and the central portion 93, can stretch and extend or retract in the direction of the arrows SA, particularly where the strap is constructed from an elastic material.

C. Toe Thickness Adjustment System

The leg pad 10 can include a toe thickness adjustment system 55 as shown in FIGS. 12-16. The toe thickness adjustment system 55 can include a cavity 57 by within the foot pad 50. The cavity 57 can be defined adjacent the boot 17, between the side rails 17A and 17B if desired. The cavity 57 can be defined between the rear 50R and the front 50F of the foot pad 50. Although described in connection with a foot pad, the toe thickness system herein can be used in conjunction with any of the other pads, for example, the knee pad, lower leg pad, thigh pad; and customized to provide desired performance characteristics involving different thicknesses of the pads.

Figure 13:
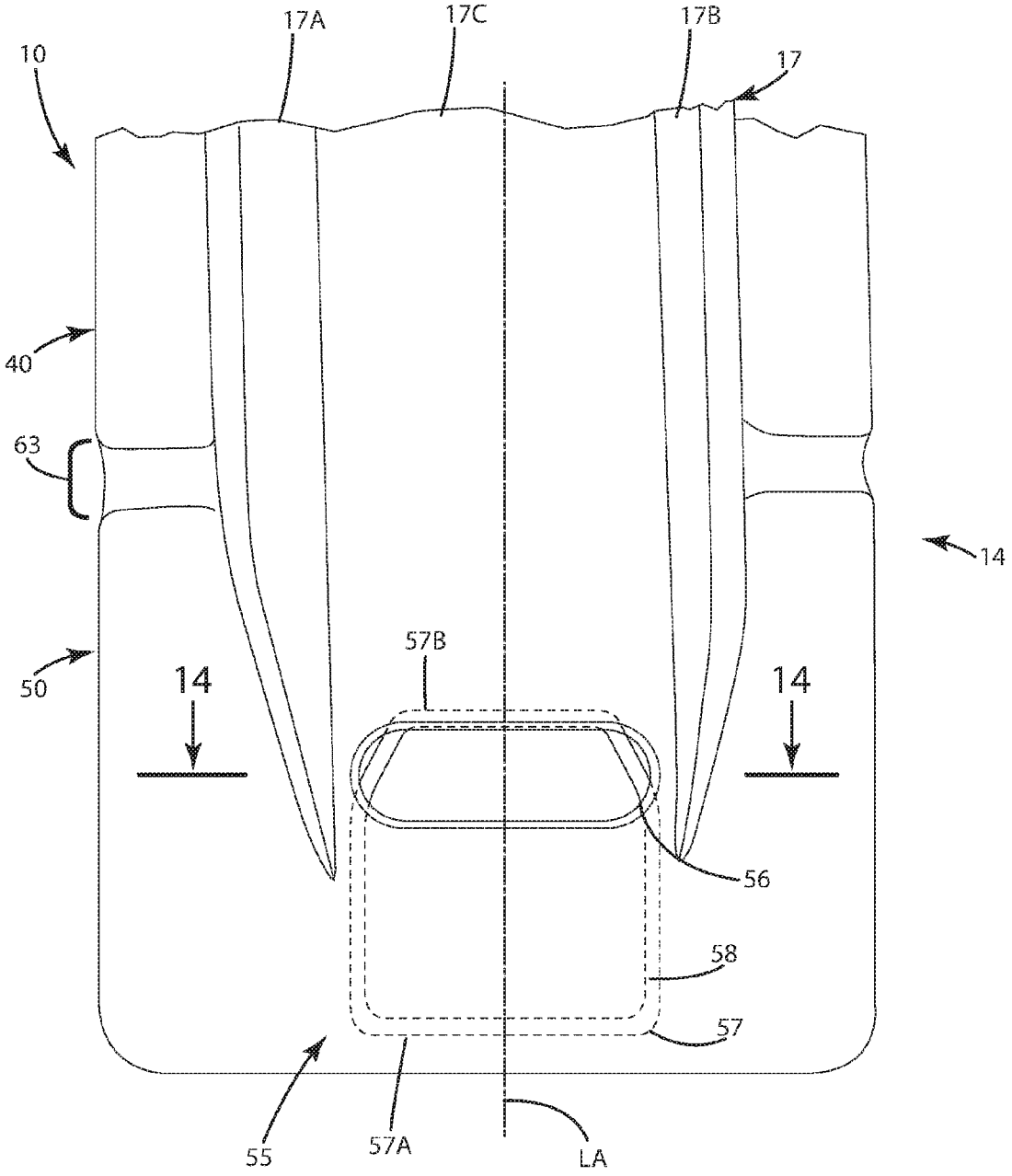
FIG. 13 is a rear perspective view of the leg pad illustrating the internal components of the toe thickness adjustment system in broken lines.

As shown in FIG. 13, the pad cavity 57 can be centered relative to the longitudinal axis LA with equal portions of the pad cavity 57 being disposed on opposite sides of the longitudinal axis LA. For example, half the pad cavity can be located on the lateral side 14 and the other half can be varied and/or located on the medial side. Of course, these portions can be offset depending on the particular application and location of the boot relative to the foot pad.

Figure 14:
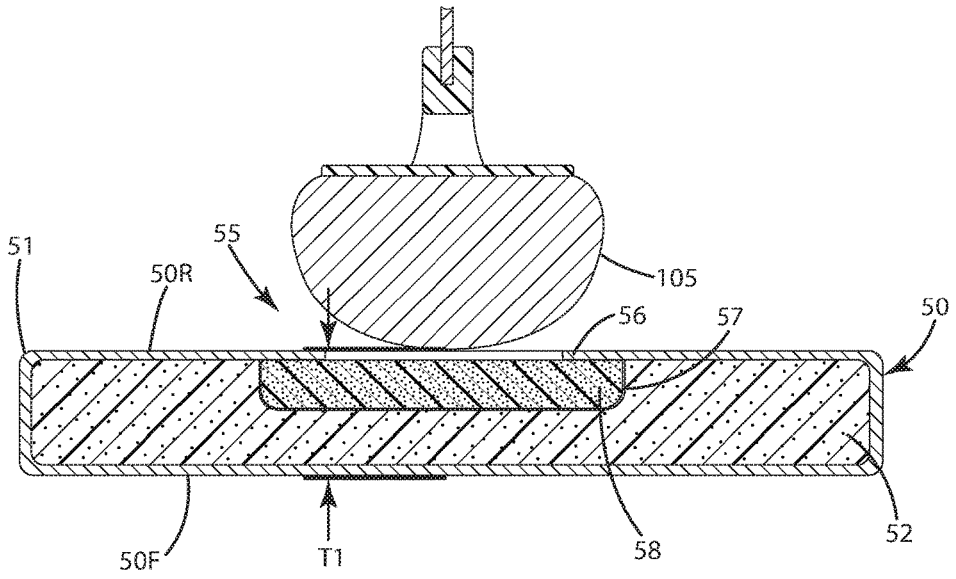
FIG. 14 is a section view of the foot pad with a secondary pad in an installed mode.

As shown in FIG. 14, the pad cavity 57 can be defined within the primary pad 52 located inside the cover 51 of the foot pad 50. Generally, the pad cavity 57 can be closed substantially by the cover 51 and the remainder of the primary pad 52. The pad cavity 57 can be formed as a recess having an open upper surface within the primary pad 52. The cover 51 can extend over and close off the upper portion of the recess to define the cavity.

The pad cavity 57 can be in communication with opening 56. The opening 56 can provide access to the pad cavity 57 through the cover 51, generally on the rear 50R of the foot pad 50. The opening 56 can be sized slightly smaller than the side-to-side lateral or other dimensions of the secondary pad 58 positioned within the pad cavity 57. Further, the opening 56 can be offset from the respective ends 57A and 57B (FIG. 13) of the pad cavity 57. In this manner, the secondary pad 58 installed in the pad cavity 57 can be less prone to moving, sliding and/or exiting through the opening 56.

As shown, the opening 56 is generally in an oval or elliptical configuration. Of course, the opening can be in a variety of other geometric shapes. For example, it can be rectangular, square, triangular, polygonal, generally rounded or any shape that facilitates intentional, manual removal of the secondary pad 58 from the foot pad 50, and more particularly, the pad cavity 57 can be used.

With the opening 56, a user can generally install and/or remove the secondary pad 58 to and/or from the pad cavity 57. The secondary pad 58 can be constructed to substantially fill the pad cavity 57 when placed therein. Optionally, the corners and edges of the secondary pad 58 can be rounded to facilitate installation through the opening 56. The secondary pad 58 can be constructed from the same material, for example, foam, as the primary pad 52 of the foot pad 50. Further, the secondary pad can be considered to be manually and non-destructively removable from the pad cavity 57. For example, the covering 51, and the foot pad 50 need not be torn, cut or have stitching pulled to remove the secondary pad 58 from the pad cavity 57.

Figure 12:
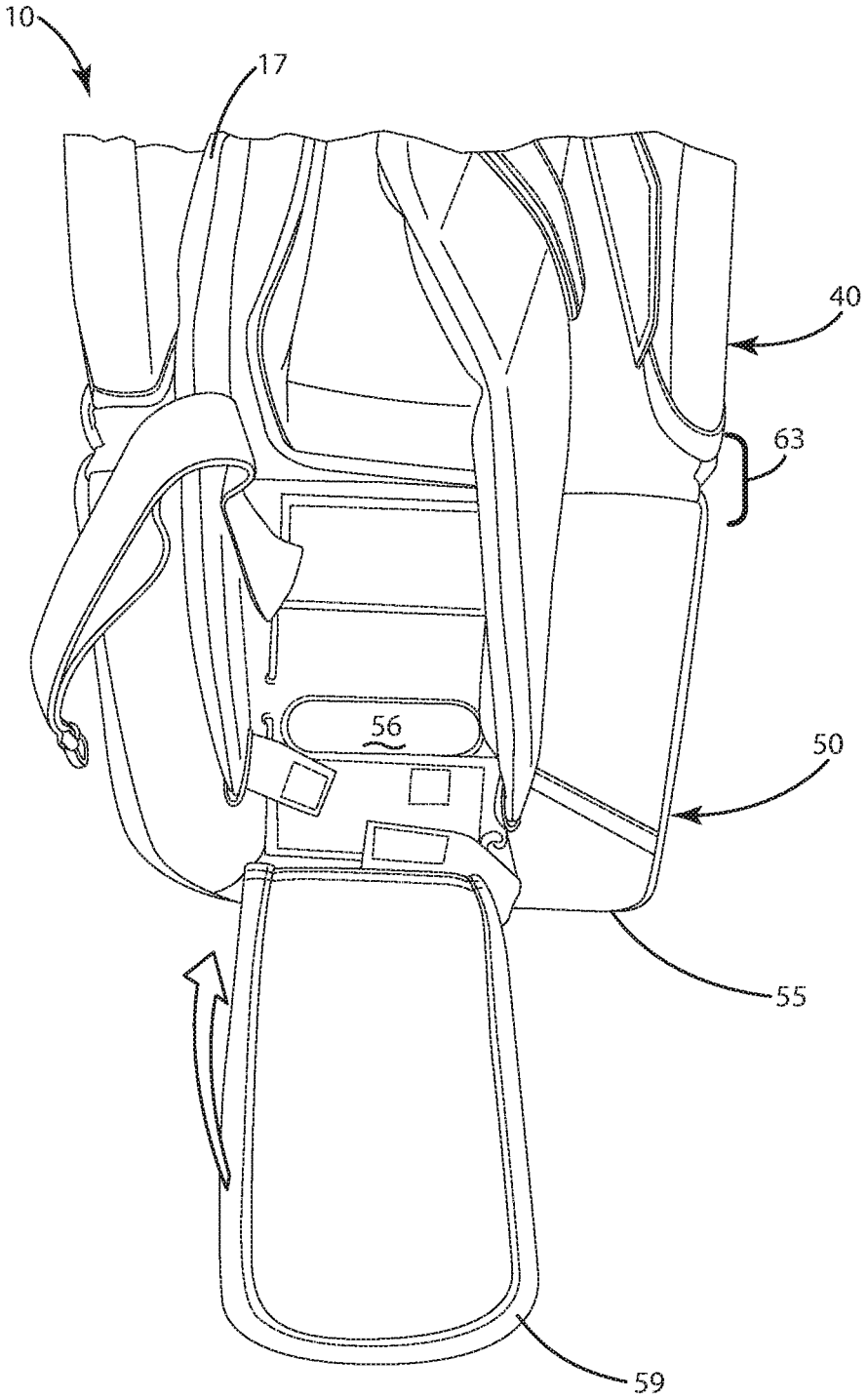
FIG. 12 is a rear view of the leg pad illustrating a toe thickness adjustment construction with a closure flap opened.

Optionally, the toe thickness adjustment system 55 can include a closure flap 59 as shown in FIG. 12. The closure flap 59 can be folded upward to cover the opening 56 in the direction of the arrow shown in FIG. 12. When the closure flap 59 is closed, it is generally in the position shown in FIG. 8. There, it is located within the boot 17 in the channel 17C between the rails 17A and 17B. The closure flap 59 may or may not include fastening elements to hold it in a closed position. The force of the skate against the closure flap, sandwiching the closure flap 59 between the skate and the foot pad 50, can hold it in position. If desired, the closure flap 59 can include additional padding.

Returning to FIGS. 14 and 15, the toe adjustment system 55 is constructed so that the secondary pad 58 is removably disposed in the pad cavity 58. The secondary pad, and generally the toe adjustment system 55, is operable in a first mode and a second mode, and more particularly, the secondary pad is operable in a installed mode and a removed mode. In the installed mode shown in FIG. 14, the secondary pad 58 is disposed in the pad cavity. With the secondary pad 58 installed, the toe thickness adjustment system 55 provides a first thickness T1 to the foot pad 50, generally between the front 50F and rear 50R of the foot pad 50. In turn, the foot pad 50 rides higher on the skate 105.

Figure 15:
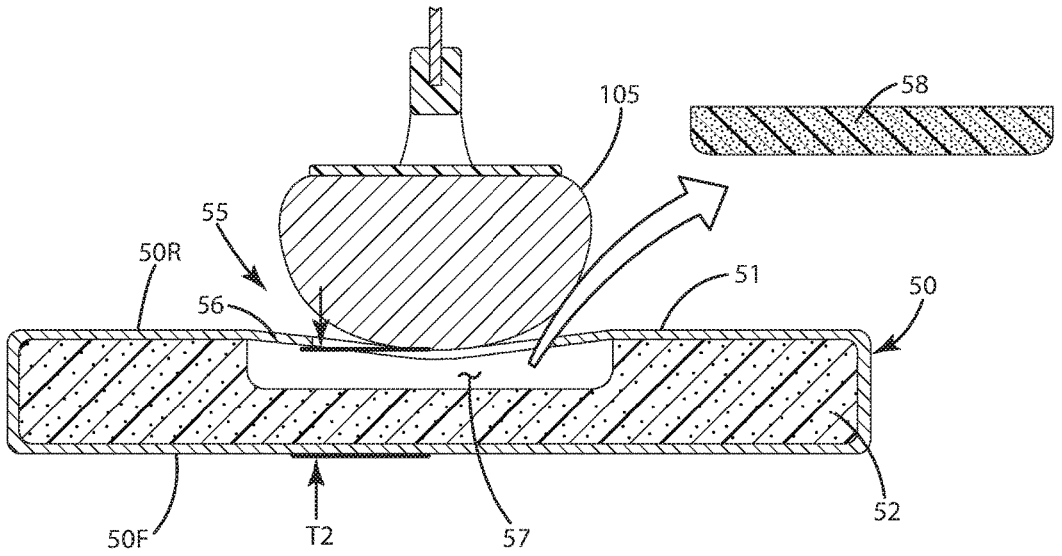
FIG. 15 is a section view of the foot pad with the secondary pad in a removed mode.

FIG. 15 illustrates the toe thickness adjustment system in the second mode generally with the secondary pad 58 in the removed mode. There, the secondary pad 58 is removed from the pad cavity 57. With the pad 58 removed, a second thickness T2 is provided between the front 50F and the rear 50R of the foot pad 50. This second thickness is less than the first thickness. In comparison, the second thickness can be ¼, ½, or ¾ less than first thickness T1, depending on the particular application. With the secondary pad 58 removed, the foot pad 50 rides lower on the skate 105, and the skate optionally partially fills in or moves into the pad cavity 57. Generally, in doing so, the front 50F and the rear 50R of the foot pad 50 are compressed or moved closer to one another with the secondary pad 58 is removed. In some cases, the skate 105 moves substantially inwardly into the pad cavity 57 and can push the cover 51 in the rear 50R of the foot pad into engagement with the bottom of the cavity 57, generally engaging the primary pad 52.

Figure 16:
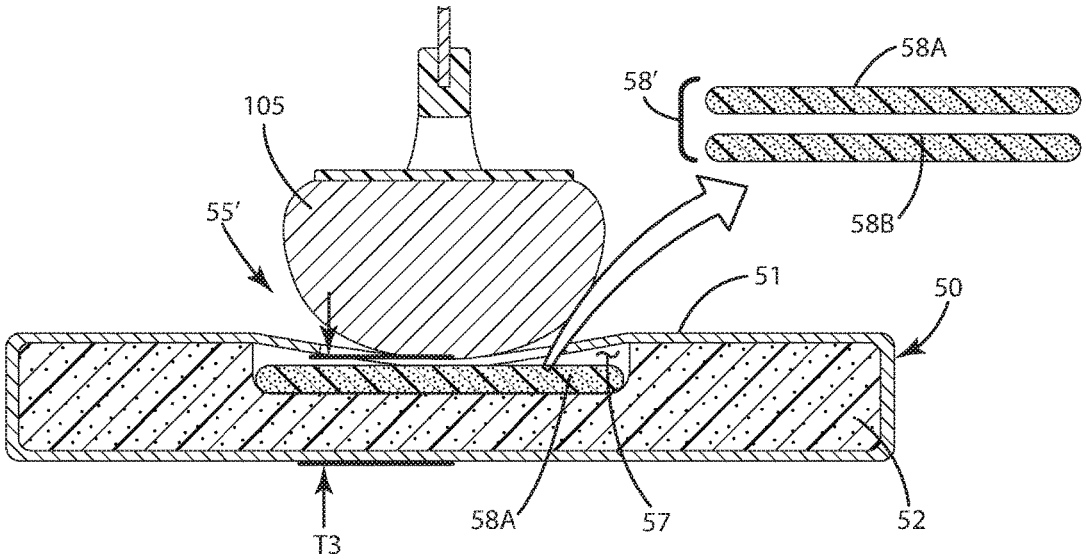
FIG. 16 is a section view of the foot pad with an alternative secondary and tertiary pad.

Optionally, the secondary pad 58 of the toe thickness adjustment system 55 can be modified. For example, as shown in FIG. 16, the alternative secondary pad 58' there includes first and second parts 58A and 58B. The first part 58A can be considered the secondary pad and the second part 58B can be considered a tertiary pad. A user can selectively install one or both the secondary pad 58A and the tertiary pad 58B. By installing only one of these two pads in the pad cavity 57, as shown in FIG. 16, the user can adjust the toe thickness of the foot pad 50 to a third thickness T3. This third thickness can be less than the first thickness T1 but greater than the second thickness T2 as illustrated in FIGS. 14 and 15.

If desired, a user can also install both the secondary pad 58A and the tertiary pad 58B in the cavity 57 to achieve the greater thickness T1 of the toe pad. The secondary pad 58A and tertiary pad 58B in FIG. 16 can both be of the same thicknesses. For example, both can be ¼ inch, ½ inch, ¾ inch, or more or less depending on the application. Alternatively, the thicknesses of pads 58A and 58B can be different. For example, secondary pad 58A can be ¼ inch and the tertiary pad 58B can be ½ inch. Thus, the user can select between ¼ inch thickness, ½ inch thickness, or when combined, ¾ inch thickness for the overall foot pad thickness over the skate 105.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The invention claimed is:

1. A goaltender leg pad comprising:

an upper leg pad adapted to cover at least a user's knee;

a lower leg pad joined with the upper leg pad below the upper leg pad, a foot pad joined with the lower leg pad below the lower leg pad, a boot extending from the lower leg pad, the boot adapted to receive at least one of a user's skate, a user's lower leg and a user's shin;

a longitudinal axis extending through the upper leg pad, lower leg pad and foot pad, generally separating the leg pad into a lateral side and a medial side, a toe attachment strap joined with the foot pad, the toe attachment strap including a first end, a second end and a central portion extending between the first end and the second end, the toe attachment strap adapted to join with a user's skate, thereby securing the user's skate to the foot pad, a redirection element joined with at least one of the foot pad and the boot on the medial side of the longitudinal axis, the redirection element engaging the central portion of the strap, allowing the central portion to slide freely relative to the redirection element, wherein the strap is constructed from an elastic material so that the central portion stretches and retracts between the redirection element and the second end, and between the redirection element and the first end, wherein the strap generally centrally locates the foot pad over the user's skate when the user transitions to at least one of a standing position and a crouching position.

2. The goaltender leg pad of claim 1 comprising a sleeve joined with at least one of the boot and the foot pad, wherein the redirection element is an opening defined by the sleeve, wherein the central portion is adapted to stretch and retract in the sleeve.

3. The goaltender leg pad of claim 2,
wherein the sleeve extends from the lateral side to the medial side, traversing the longitudinal axis,
wherein the opening defined by the sleeve is located on the medial side.

4. The goaltender leg pad of claim 3,
wherein the first end of the strap is fixedly joined with at least one of the foot pad and the boot on the lateral side,
wherein the second end is removably joined with a fastening element with the at least one of the foot pad and the boot on the lateral side.

5. The goaltender leg pad of claim 2 wherein the redirection element is a D ring joined with at least one of the boot and the foot pad.

6. The goaltender leg pad of claim 2,
wherein the first end is joined with the foot pad on the lateral side,
wherein the central portion of the strap extends across the longitudinal axis from the medial side to the lateral side,
wherein the second end is joined with the foot pad on the lateral side.

7. A goaltender leg pad comprising:
a leg pad,
a foot pad joined with the leg pad,
a toe attachment strap joined with the foot pad, the toe attachment strap including a first end, a second end and a central portion extending between the first end and the second end,
a longitudinal axis extending through the foot pad, generally bisecting the foot pad into a lateral side and a medial side,
wherein the first end of the strap is secured to the foot pad on the lateral side of the longitudinal axis,
wherein the central portion of the strap traverses the longitudinal axis generally extending from the lateral side to the medial side and back across from the medial side to the lateral side,
wherein the central portion of the strap slidably engages a redirection element on the medial side,
wherein the second end of the strap is manually, detachably joined with the foot pad,
whereby a user can position the central portion of the toe attachment strap through a portion of a user's skate to secure the foot pad to the user's skate so that the toe attachment strap centrally locates the foot pad over the user's skate when the user transitions to at least one of a standing position and a crouching position.

8. The goaltender leg pad of claim 7 comprising a sleeve traversing the longitudinal axis, wherein the central portion is movably disposed in the sleeve.

9. The goaltender leg pad of claim 7 wherein the sleeve defines an opening on the medial side of the longitudinal axis, wherein the opening is the redirection element.

10. The goaltender leg pad of claim 7 wherein the redirection element is a D loop joined with the foot pad.

11. The goaltender leg pad of claim 7 wherein the attachment strap is an elastic member configured to stretch and retract longitudinally.

12. The goaltender leg pad of claim 11,
wherein the elastic member is partially disposed in a sleeve,
wherein the sleeve extends across the longitudinal axis,
wherein the sleeve defines an opening that forms the redirection element.

13. The goaltender leg pad of claim 12 wherein the central portion stretches and retracts within the sleeve and between the redirection element and the second end when a user transitions to at least one of a standing and crouching position.

14. A goaltender leg pad comprising:
a leg pad,
a foot pad joined with the leg pad,
a boot extending from the leg pad to receive at least one of a user's skate, a user's lower leg and a user's shin;
a longitudinal axis extending through the leg pad and foot pad, separating the leg pad and the foot pad into a lateral side and a medial side,
a toe attachment strap joined with at least one of the foot pad and the boot, the toe attachment strap adapted to join with a user's skate, thereby securing the user's skate to the foot pad,
a redirection element joined with at least one of the boot and the foot pad, the redirection element engaging the toe attachment strap but allowing the toe attachment strap to slide relative to the redirection element,
wherein the toe attachment strap extends away from the longitudinal axis on the medial side, toward the redirection element, engages the redirection element, and extends back toward the longitudinal axis on the medial side,
whereby a user can position the toe attachment strap through a portion of the user's skate to secure the foot pad to the user's skate so that the toe attachment strap centrally locates the foot pad over the user's skate when the user transitions to at least one of a standing position and a crouching position.

15. The goaltender leg pad of claim 14,
wherein the toe attachment strap is elastic and includes a central portion that engages the redirection element,
wherein the central portion slides relative to the redirection element and simultaneously stretches when the user's skate moves in a direction toward the medial side of the longitudinal axis.

16. The goaltender leg pad of claim 15 wherein the central portion slides relative to the redirection element and simultaneously retracts when the user's skate moves in a direction toward the lateral side of the longitudinal axis.

17. The goaltender leg pad of claim 14 wherein the toe attachment strap includes a first terminating end located on the lateral side of the longitudinal axis, and a second terminating end located on the lateral side of the longitudinal axis, and a central portion that extends from the first terminating end to the redirection element, and from the redirection element to the second terminating end, traversing the longitudinal axis.

18. The goaltender leg pad of claim 14 wherein the toe attachment strap is disposed in a sleeve joined with at least one of the boot and the toe pad, wherein the sleeve defines an opening that forms the redirection element.

19. The goaltender leg pad of claim 18 wherein the toe attachment strap is elastic and stretches and retracts in the sleeve when a user's skate moves toward at least one of the lateral side and the medial side.

20. The goaltender leg pad of claim 14 wherein the toe attachment strap engages the redirection element and pivots about the redirection element.

* * * * *